United States Patent [19]

Fougea

[11] 3,931,951

[45] Jan. 13, 1976

[54] MOBILE PALLET FOR AN INSTALLATION FOR PRODUCTION OF PRE-FABRICATED ELEMENTS OF CONCRETE

[75] Inventor: Edouard Marie Fougea, Paris, France

[73] Assignee: Constructions Edmond Coignet, Paris, France

[22] Filed: Nov. 6, 1972

[21] Appl. No.: 303,867

[30] Foreign Application Priority Data

Nov. 23, 1971 France ..... 71.41790

[52] U.S. Cl. ..... 249/158; 249/172

[51] Int. Cl.² ..... B28B 7/04

[58] Field of Search ..... 249/170–172, 249/158; 425/450 C

[56] References Cited

UNITED STATES PATENTS

| | | | |
|---|---|---|---|
| 771,143 | 9/1904 | Goodwin | 249/158 X |
| 836,448 | 11/1906 | Latimer | 249/172 X |
| 942,457 | 12/1909 | Nicolai | 249/161 X |
| 1,006,053 | 10/1911 | Bolles | 249/172 X |
| 1,578,103 | 3/1926 | Suttill et al. | 249/172 X |
| 3,171,163 | 3/1965 | Ford et al. | 249/170 UX |

*Primary Examiner*—Robert D. Baldwin
*Attorney, Agent, or Firm*—Diller, Brown, Ramik & Wight

[57] ABSTRACT

An installation for the manufacture of prefabricated elements of ordinary or reinforced concrete comprises one or more mobile molding pallets, each including a pouring table, a plurality of molding cheeks continuously coupled to said table and mounted individually with respect to said table so as to move between a closure position adapted to form a cavity for molding said concrete elements and an open position in which said elements can be de-molded, means being mounted on said table and associated with each said cheek for actuating the opening and closure of said cheeks and for locking said cheeks in the closed position. The installation described has a plurality of work stations between the pouring and final de-molding stages, arranged in two lines with a transfer station between lines.

10 Claims, 25 Drawing Figures

MOBILE PALLET FOR AN INSTALLATION FOR PRODUCTION OF PRE-FABRICATED ELEMENTS OF CONCRETE

The present invention generally relates to the production of pre-fabricated elements of plain or reinforced concrete.

The production installations for such elements currently utilize movable pallets or tables which can be displaced from one working station to another.

Pallets of this kind each comprise an assembly of moulding cheeks which form a cavity permitting the moulding of an element in concrete which may be reinforced. From one station of the installation to another there are successively effected the following operations: putting in position any possible reinforcement, pouring of the concrete, with vibration if so desired, drying, possibly by stoving, and de-moulding.

Up to the present time, the cheeks associated with such a movable pallet, are fixed to this latter, at least temporarily, by mechanisms which necessitate a manual action for their closure, that is to say for their placing in a position at which they form, conjointly with the others, the moulding cavity, and also for their opening, that is to say for their passage to a disengaged position in which they permit de-moulding of the previously cast element.

In most cases, after opening, these cheeks do not remain attached to the associate pallet, which necessitates their handling and therefore makes it essential to have a special staff attached to this operation.

In addition, the closure of these cheeks is most frequently effected at the present time either by bolting, or by hydraulic control means associated with the pallet or table on which they are carried.

This bolting necessitates a relatively long mechanical action; it does not ensure a strictly accurate position of closure of the cheeks and has a poor resistance to the powerful vibration to which the pallet is subjected during the pouring of the concrete.

As far as the hydraulic control means are concerned, these render the passage of the pallets into a stove to accelerate drying of the concrete, difficult.

The present invention has especially for its object a pallet which enables these disadvantages to be overcome.

It has also for its object an installation which utilizes pallets of this kind.

According to the invention, a movable pallet for an installation for the production of pre-fabricated elements of concrete, which may be reinforced, is characterized in that it comprises a pouring table and, permanently coupled to the said table, an assembly of moulding cheeks movably mounted individually with respect to the said table between a closure position, for which they form together with the table, a cavity permitting the moulding of a concrete element, which may be reinforced, and a position of opening, in which they permit the demoulding of an element, the said table being further provided, for each of the said cheeks, with operating means for opening and closure, and means for locking in the closed position.

Thus, according to a first aspect of the invention, all the cheeks carried by a pallet remain permanently attached thereto after their opening, which eliminates any handling operation and thus results in a substantial saving of time.

Furthermore, due to the operating means and locking means associated with each cheek, the cheeks always return automatically during their closure, to the same position, and are locked automatically and instantaneously in that position without there being any need for bolting or manual interventions of any kind.

This results in a better dimensional quality for the moulding cavity thus formed, together with a saving of time.

In addition, a pallet equipped with cheeks of this kind can be moved from one station to another, and can even be powerfully vibrated without the position of these cheeks being modified with respect to the moulding table of this pallet or with respect to itself.

The means for locking the closure of any cheek are preferably mechanical and utilize an accumulator comprising a piston moving in a cylinder body against the action of elastic means.

As these locking means are not associated with any hydraulic circuit, the pallets according to the invention can be stoved without any difficulty, and may for example be passed through heating tunnels.

In addition, the reaction of the elastic means provided on such an accumulator is advantageously opposed to the opening forces which act on each cheek after the pouring of an element, as a result of the thrust applied by the concrete against this cheek.

The means for locking the closure of any cheek conjointly comprise a control lever capable of coming into engagement with an opening and closure mechanism provided for that purpose at certain stations of the installation.

Thus, an installation according to the invention is characterized in this respect by the fact that it comprises a succession of working stations such as a preparation station, a pouring and/or vibration station, a drying and/or stoving station, a de-moulding station, possibly of the tilting type, and a transfer station, at least some of these stations being equipped with at least one mechanism adapted to actuate the opening and/or the closure of at least one of the cheeks of the pallets which are placed in position in the said station.

This arrangement makes it possible to use only a small number of such control mechanisms for the whole of the installation, instead of one mechanism per pallet, which correspondingly reduces the production costs.

It also enables manual operation to be eliminated to limit the power employed and to save time, thereby reducing still further the production cost of the prefabricated elements obtained.

The characteristic features and advantages of the invention will furthermore be brought out in the description which follows below, given by way of example only, reference being made to the accompanying diagrammatic drawings, in which.

Figure 1:
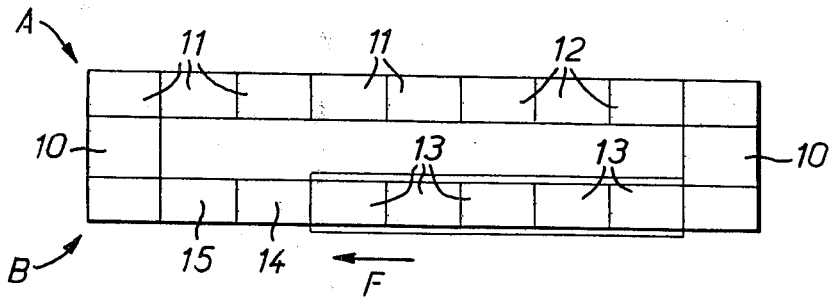
FIG. 1 is a diagrammatic plan view of an installation according to the invention.
Figure 10A:
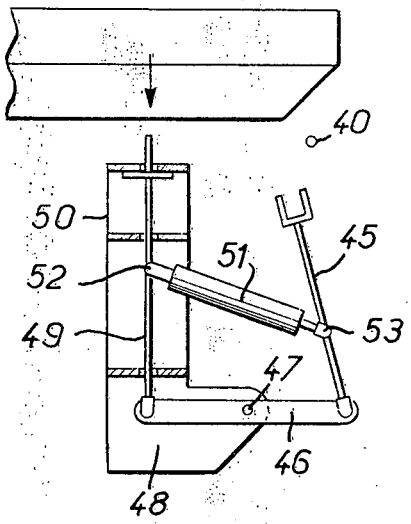
Figure 10B:
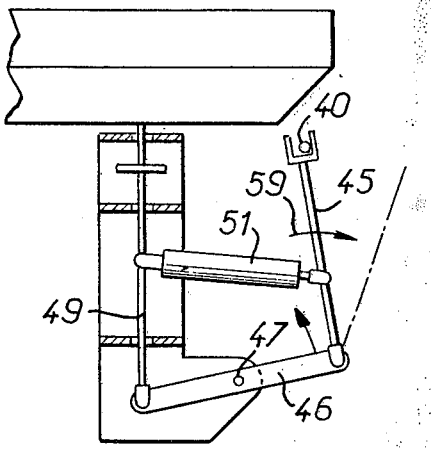
Figure 10C:
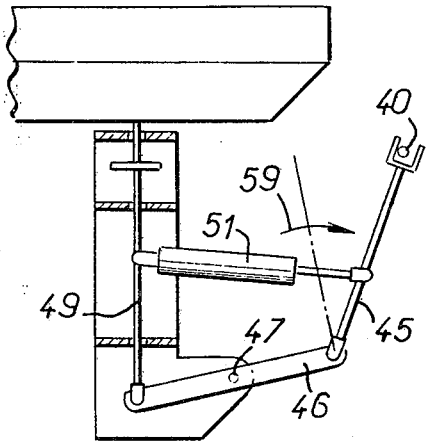
Figure 11A:
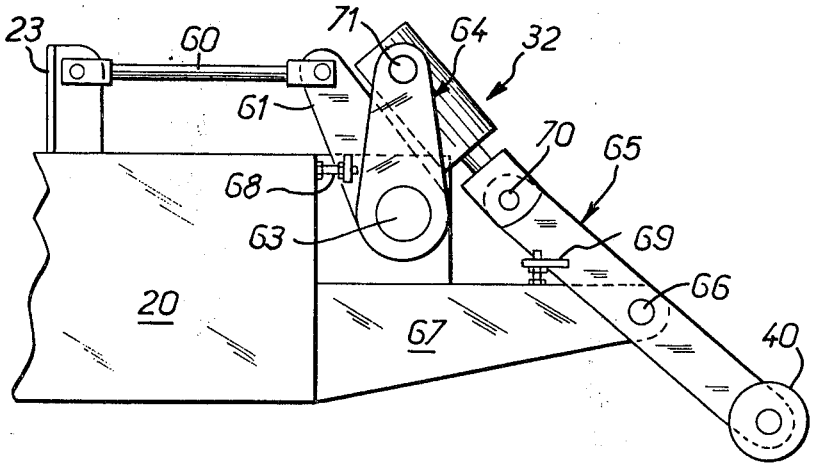
Figure 11B:
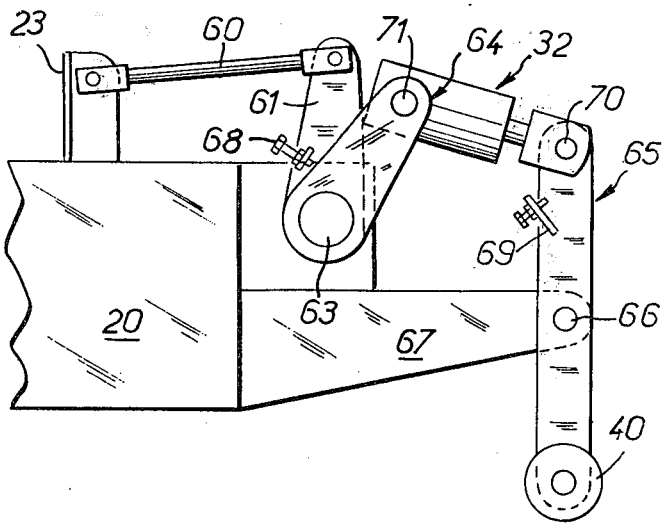
Figure 12:
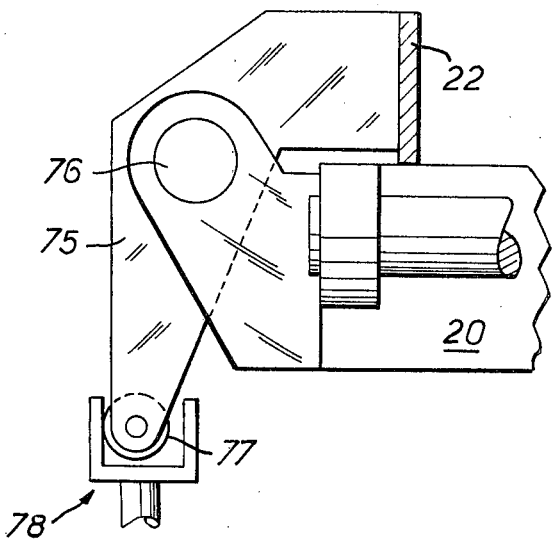
Figure 13:
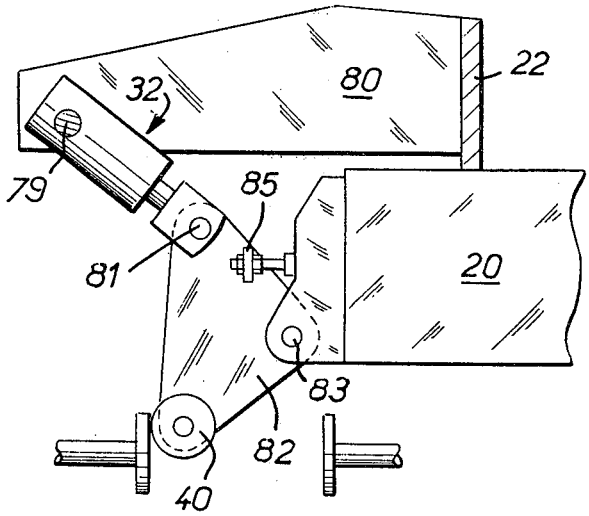
Figure 14A:
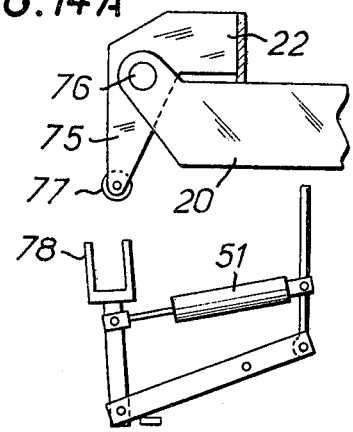
Figure 14B:
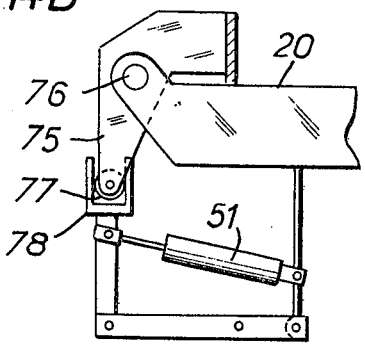
Figure 14C:
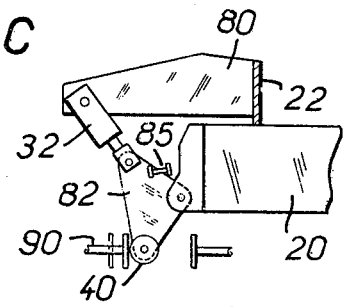
Figure 14D:
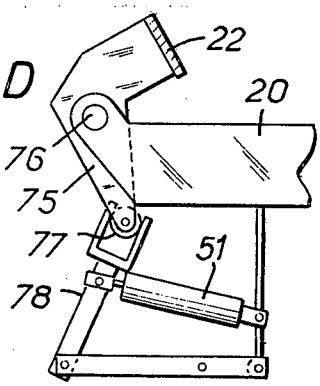
Figure 14E:
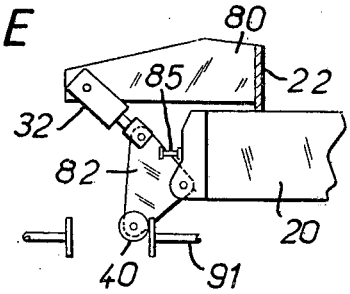
Figure 15:
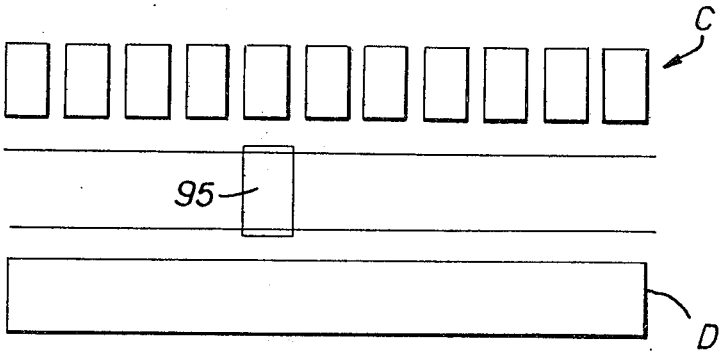

FIGS. 9*a*, 9*b*, 9*c* and 9*d* illustrate diagrammatically the opening of a cheek of this kind;

FIGS. 10A, 10B and 10C illustrate diagrammatically the closure of this cheek;

FIG. 11A is a diagrammatic view in side elevation of another cheek provided on the pallet according to the invention, known as a lateral cheek, in the closed position;

FIG. 11B is a view similar to FIG. 11A, the side cheek considered being shown in the open position;

FIG. 12 is a diagrammatic view in side elevation of another cheek provided on the movable pallet according to the invention, known as the low cheek, and more particularly shows the control of the opening and closure of this cheek;

FIG. 13 is a view similar to FIG. 12, and relates to the locking means associated with this cheek;

FIGS. 14A, 14B, 14C and 14D illustrate successively the unlocking and the opening of the low cheek;

FIG. 14E illustrates the locking of the low cheek;

FIG. 15 is a view similar to FIG. 1 and relates to an alternative form of arrangement of an installation according to the invention.

As illustrated in FIG. 1, an installation according to the invention forms a kind of tilt-yard comprising a plurality of work stations distributed in two lines A and B, coupled together at the two extremities by transfer stations 10.

For example, line A comprises the preparation stations 11 followed by the pouring and vibration stations 12.

In parallel, line B comprises for example stoving stations 13, an outlet station 14 and a tipping and demoulding station 15.

Figure 2:
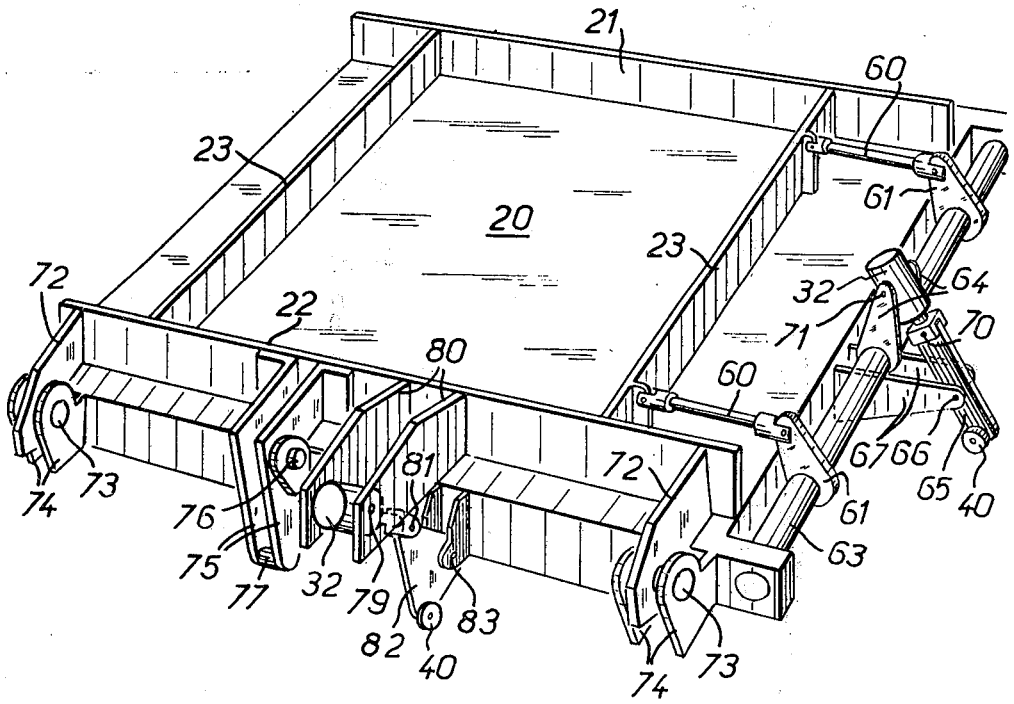
FIG. 2 is a perspective view of a movable pallet according to the invention.

By the aid of circulation means (not shown) mobile pallets, such as those shown separately in FIG. 2, are moved from one station to another in the direction of the arrow F.

A mobile pallet of this kind comprises a moulding table 20 and a plurality of cheeks, four in number in the example shown.

There are in the first place two cheeks 21, 22 pivotally mounted about fixed shafts parallel to each other, and known hereinafter by the terms high cheek and low cheek. There are also two similar cheeks 23 slidably mounted between the high cheek 21 and the low cheek 22 and hereinafter known as the side cheeks.

Each of these cheeks and their operating mechanisms will be described successively.

The high cheek 21, FIGS. 3 to 7, is carried by side-plates 26 which constitute conjointly a supporting arm in the shape of a fork and which are mounted pivotally about a fixed shaft 27 coupled to the moulding table 20 by side-plates 28.

With this high cheek are associated means for locking when closed, which constitute also operating means for opening and closing.

These means comprise an operating lever 29 consisting of two parallel plates and having a generally triangular shape; this operating lever is articulated about a first pivot 30 fixed opposite the table 20, this pivot being carried by the plates 28 coupled to the table.

The operating lever 29 carries a second pivot 31 on which is articulated an elastic coupling lever 32, also articulated about a third pivot 33 carried by the plates or supporting arms 26 which carry the cheek 21.

Figure 8:
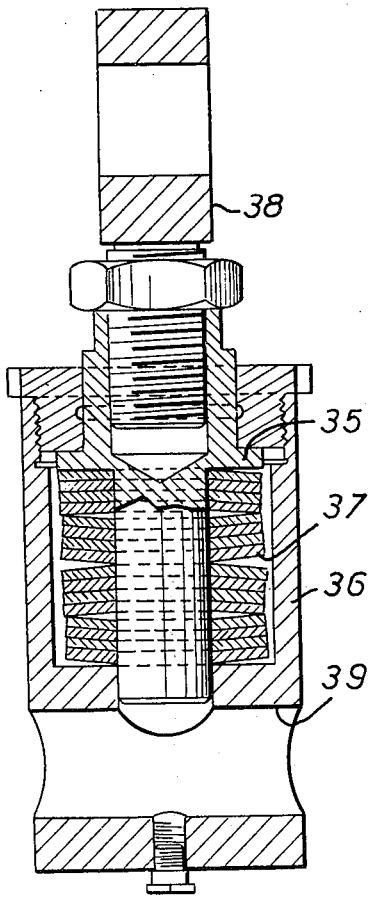
FIG. 8 is a view in axial cross-section, taken on a different scale, of an accumulator utilized for the operation of a cheek of this kind.

The elastic coupling lever 32, shown separately in FIG. 8 is an accumulator comprising a piston 35 movably mounted in a cylinder body 36 against the action of elastic means 37 which, in the example shown, are constituted by a stack of elastic washers of the Belleville type.

The piston 35 terminates in a lug 38 which permits its engagement on the second pivot 31, and similarly, the cylinder body 36 is provided with a passage 39 permitting its engagement on the third pivot 33.

At one free extremity, the operating plates or levers 29 carry a driving member, for example a roller 40, as shown.

This operating lever also carries an abutment 41, preferably adjustable in length, a screw for example as shown, with which are associated lock-nuts.

The supporting arm 26 carries an abutment 42 which is similarly adjustable in length.

The abutment 41 is intended to co-operate with the side-plates 28 coupled to the moulding table 20, and the abutment 42 is intended to co-operate directly with the said moulding table.

Figure 3:
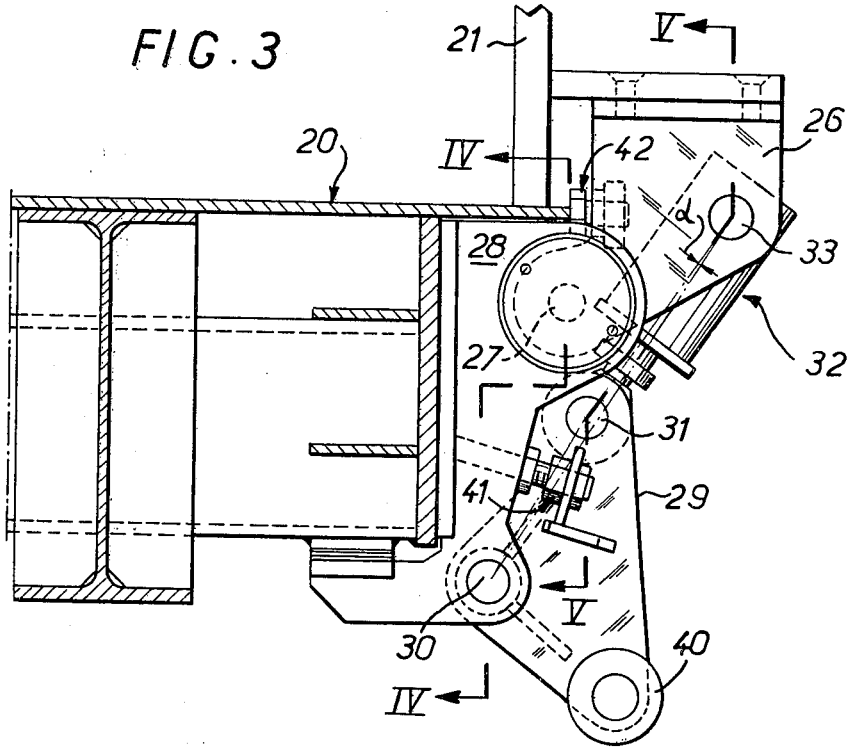
FIG. 3 is a view in transverse section, taken along the line III-III of FIG. 4, of a first cheek provided on this pallet, known as a high cheek, shown in the closed and locked position.
Figure 4:
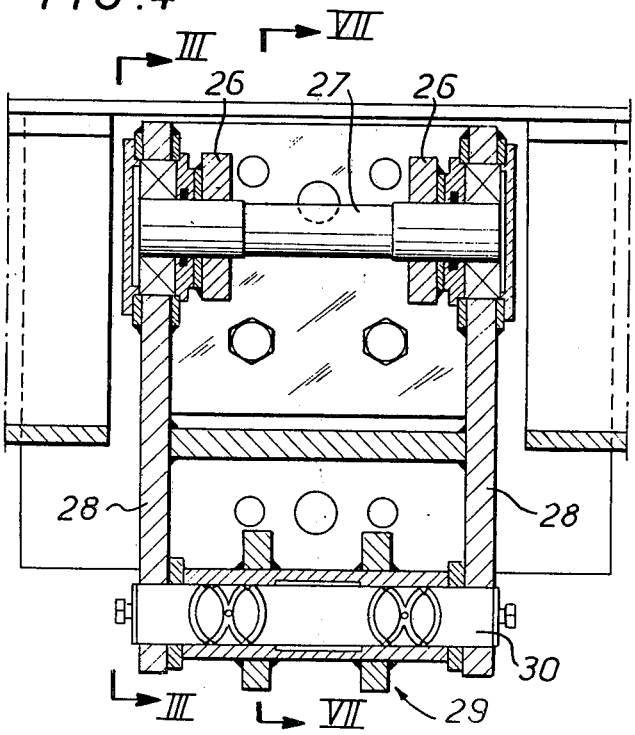
FIGS. 4 and 5 are views in cross-section taken respectively along the lines IV—IV and V—V of FIG. 3.
Figure 5:
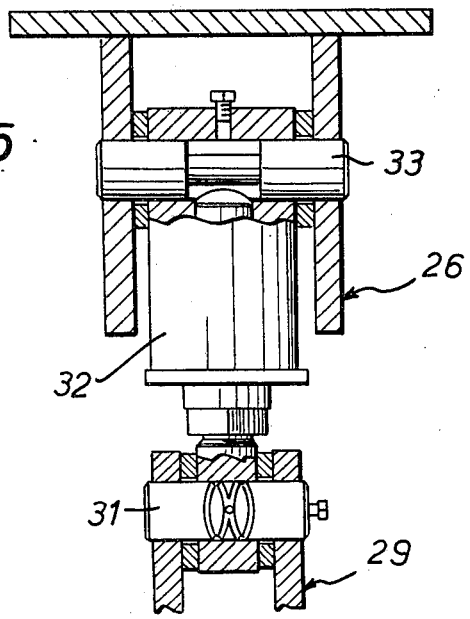

These stops are adjusted in such manner that, for the closed and locked position shown in FIG. 3, the pivots 30, 31 and 33 are not in line, the pivot 31 being displaced in the direction of the moulding table 20 with respect to the line formed by the pivots 30 and 33. The alignment of the pivots 33 and 31 forms an angle $\alpha$ with the line of the pivots 33 and 30.

For this locking position, the stack of Belleville washers of the lever forming the accumulator 32 is compressed and elastically holds the cheek 21 in the closed position.

Figure 6:
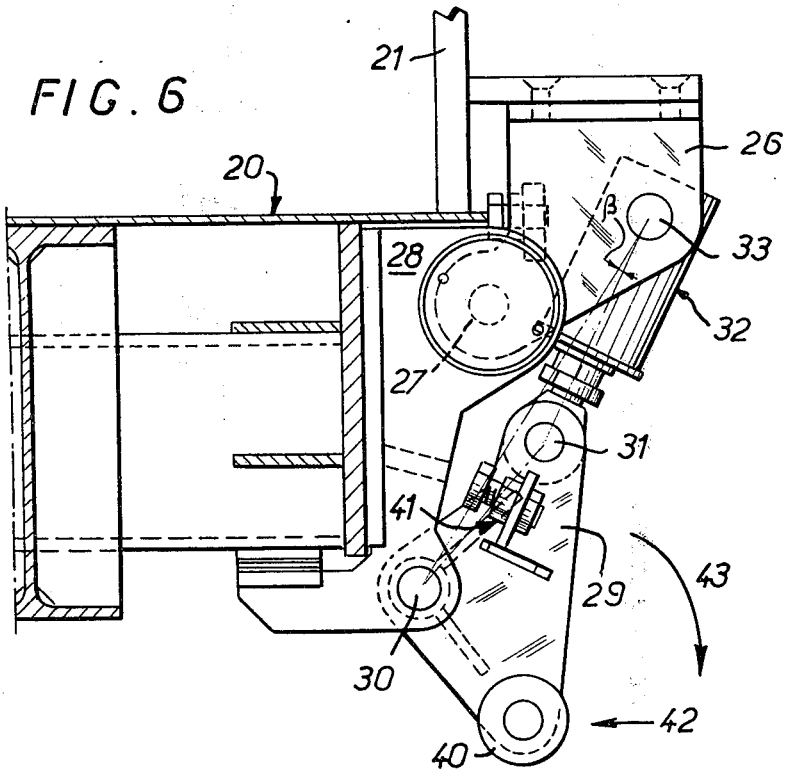
FIG. 6 is a view similar to FIG. 3, the cheek considered being shown in the unlocked position.

If action is taken on the driving member 40 of the operating lever 29, in the direction of the arrow 42 of FIG. 6, there is a pivotal movement of this operating lever about the first pivot 30 in the direction of the arrow 43 and a crossing by the second pivot 31 of the line formed by the pivots 30 and 33. The alignment of the pivots 33 and 31 forms an angle $\beta$ with the alignment of the pivots 33 and 30.

This crossing is effected against the action of the stack of Belleville washers of the lever 32, and corresponds to a neutral position beyond which the cheek 21 is unlocked.

Figure 7:
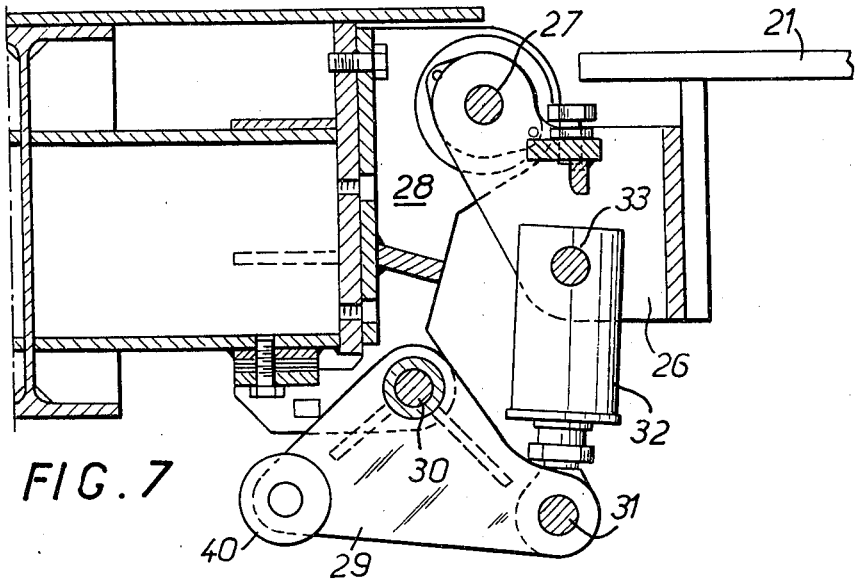
FIG. 7 is a view similar to FIG. 3, the cheek considered being shown in the open position.

In fact, if action is continued on the driving member 40, and under the action of decompression of the stack of Belleville washers of the elastic lever 32, the operating lever 29 continues its pivotal movement in the direction of the arrow 43, which causes a pivotal movement of the supporting arm 26 of the cheek 21 and therefore the opening of this sheet, as shown in FIG. 7.

There will now be described such an opening process which takes place at the single tipping and de-moulding station 15 of the installation according to the invention. This tipping and de-moulding station shown in FIG. 9A thus comprises a mechanism suitable for controlling the opening of a high cheek 21 of this kind.

This mechanism comprises a fork 45, the extremity of which is articulated on the end of a lever 46 mounted pivotally at 47 on a frame 48.

At the other end of this lever 46 is articulated a rod 49 which is intended to form a feeler and which is slidably mounted axially in a frame 50 fixed on the base 48.

A double-acting hydraulic or pneumatic jack 51 has its body articulated on the feeler rod 49 at 52, and its rod is articulated on the fork 45 at 53.

Figure 9A:
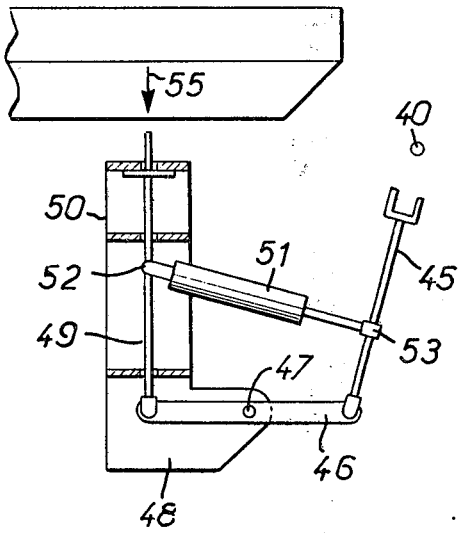
Figure 9B:
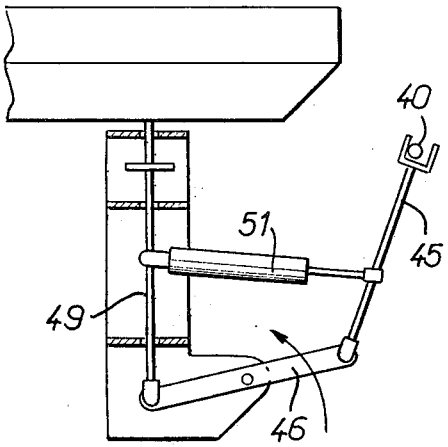

In the waiting position, that is to say in the absence of a pallet at the tipping and de-moulding station, the feeler rod 49 projects considerably out of the frame 50, FIG. 9A, and the piston rod of the jack 51 is in its extended position.

During the placing in position of a pallet at the tipping and de-moulding station, in the direction of the arrow 55 of FIG. 9A, this pallet depresses the feeler rod 49 (FIG. 9B), which has the effect, through the intermediary of the lever 46, of bringing the fork 45 into engagement with the operating roller 40 of the high cheek of the pallet considered.

Figure 9C:
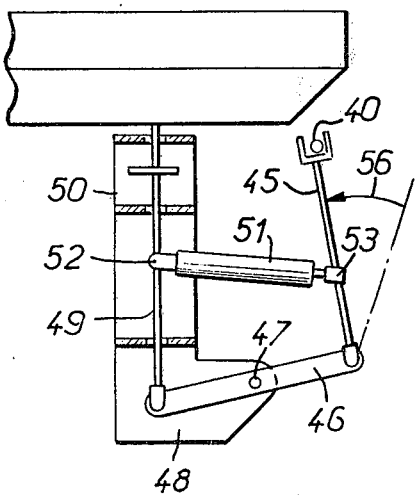

It is then only necessary to ensure the return of the piston rod of the jack 51 by appropriately sending fluid under pressure into this latter, in order to ensure the pivotal movement of the fork 45 in the direction of the arrow 56 of FIG. 9C and thereby to effect the opening of the high cheek of the pallet concerned, following the process described above.

Figure 9D:
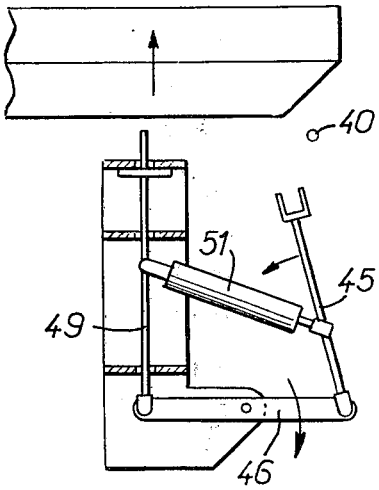

It is then possible to withdraw this pallet from the tipping and de-moulding station, with its high cheek opened, as shown in FIG. 9D.

In practice, the closure of this high cheek after de-moulding the concrete element carried by the pallet is effected during a fresh utilization of the pallet at one of the pouring and vibration stations 12, provided for that purpose with a mechanism for closure control similar to the mechanism for control of opening described above.

A closure of this kind is illustrated in FIGS. 10B and 10C. The placing in position of a pallet at the pouring and vibration station concerned acts through the feeler 49 of the closure control mechanism to ensure the engagement of the fork 45 of this mechanism with the operating roller 40 of the high cheek of this pallet (FIGS. 10B). An outward movement of the piston rod of the jack 51 then causes this fork 45 to pivot in the direction of the arrow 59 of FIG. 10B, and this fork during the course of its movement ensures the closure of the high cheek in question (see FIG. 10C).

There will now be described the process of opening and closure of a side cheek 23, with reference to FIGS. 2, 11A and 11B.

A side cheek 23 of this kind is coupled by crank-arms 60 to cranks 61 keyed on a shaft 63 carried by the table 20.

The means for effecting the opening and closure of such a side cheek which at the same time constitute the locking means, comprise as previously an elastic lever formed by an accumulator 32.

This accumulator 32 is articulated, on the one hand to a supporting arm 64 formed by two arms keyed on the shaft 63, and on the other hand on a lever 65 pivotally mounted at 66 on a bracket 67 carried by the table 20. At its free extremity, this lever 65 carries the driving member associated with such a side cheek 23, this driving member being, as previously, a single roller 40.

Also as previously described, stops 68 and 69, adjustable in length, are respectively associated with the cranks 61 and the pivoted lever 65.

For the locking position shown in FIG. 11A, these stops 68 and 69 are respectively supported against the table 20 and against the bracket 67, and conjointly, the pivot 70 by which the accumulator 32 is articulated on the lever 65 is beyond the line formed by the pivot 66 of this lever 65 and by the pivot 71 by which the accumulator 32 is articulated on its supporting arm 64.

As previously, a thrust action applied on the driving roller 40 ensures successively, after passing through a neutral point, first of all the unlocking of the side cheek 23 and then its opening as shown in FIG. 11B.

An opening operation of this kind is ensured at the single tipping station, which comprises for that purpose a mechanism similar to that described above. Following a reversed process, this same mechanism then effects the closure, followed by the locking of such a side cheek.

There will now be described in more detail a low cheek 22, reference being made to FIGS. 2 and 12 to 14.

This low cheek is carried by the side-plates 72, articulated at 73 on brackets 74 fixed on the table 20.

For a low cheek of this kind, the operating means for opening and closure are separate from the locking means.

The opening and closure operating means very simply comprise two side-plates 75 which are rigidly fixed on the low cheek 22 and which are pivotally mounted at 76 on the table 20. These side-plates 75 are coupled to each other by a driving member which is a bar 77 in the example shown.

Following a process similar to that described above, this bar or driving rod 77 is intended to co-operate with a fork 78 of an opening and closure control mechanism provided for that purpose at the tipping and de-moulding station 15 of the installation.

The operating means for locking a low cheek 22 conjointly comprise, as previously, an elastic lever forming an accumulator 32. This accumulator 32 is articulated at 79 on the plates 80 which are rigidly fixed on the cheek 22 and form a supporting arm, and is also articulated at 81 on a lever 82 which is in turn articulated at 83 on the table 20.

As previously, this pivoted lever 82 carries a driving member which may be a simple lug or a roller 40. Also as previously, this lever 82 carries a stop 85 which is adjustable in length, as shown in FIG. 13.

For the locked position shown in FIG. 13, this stop 85 is supported against a member rigidly fixed to the table 20, and the pivot 81 on which the accumulator 32 is articulated to the lever 82 is outside the line of the pivot 79 though which the accumulator 32 is articulated at its supporting point 80, and of the pivot 86 by which the lever 82 is articulated on the table 20.

The opening of a low cheek is carried out at the tipping and de-moulding station of the installation by means of a mechanism similar to that described above.

The fork 78 of a mechanism of this kind comes first of all into engagement with the rod 77 when the pallet is placed in position in this tipping station, as shown in FIGS. 14A and 14B.

An unlocking jack, the piston rod of which is shown at 90 in FIG. 14C is then brought into action, and this piston rod acts on the roller 40 of the locking mechanism in order to unlock or release the low cheek 22, following a process similar to that previously described above.

It is then only necessary to ensure the opening of this low cheek (FIG. 14B) also following a process similar to that described above, by means of the jack 51 of the opening mechanism.

The closure is carried out by an inverse process.

As regards the consecutive locking after this closure, this is ensured by a locking jack, the piston rod of which is shown at 91 in FIG. 14E. This jack is utilized up to the crossing of the neutral point existing in the coupling between the accumulator 32 and the lever 82 to which this latter is articulated, and up to the point of contact of the stop 85 with the table 20.

It will have been noted that the installation according to the invention only comprises a limited number of opening and closure operating mechanisms, namely:

a mechanism for opening the high cheek at the de-moulding and tipping station 15;

a mechanism for closing the high cheek at a pouring and vibration station 12;

two mechanisms for opening and closing the side cheeks at the de-moulding and tipping station 15.

At this latter station, a pallet is tipped in a manner well known per se, until it becomes substantially vertical, in order to facilitate de-moulding and extraction of the fabricated element which, during this operation, rests only on the low cheek (not shown).

According to the alternative form of construction shown in FIG. 15, the preparation stations 11, the pouring and vibration stations 12 and the tipping station 15 of the installation according to the invention are all arranged along a single line C, parallel to a line D of stoving stations, in combination with a transfer station 95 arranged between these two lines.

It will of course be understood that the present invention is not limited to the forms of embodiment described and illustrated, but includes all alternative forms of construction.

I claim:

1. In an installation for the manufacture of prefabricated elements, of plain or reinforced concrete, a mobile pallet comprising: a pouring table, a plurality of molding cheeks continuously coupled to said table and movably mounted individually with respect to said table between a closure position adapted to form with said table a cavity for molding said concrete elements, and an open position permitting de-molding of said elements; and means mounted on said table and associated with each said cheek for actuating the opening and closure of said cheeks and for locking said cheeks in the closed position, said molding cheeks include a high cheek and a low cheek, means mounting said high cheek and said low cheek for pivotal movement about fixed shafts disposed parallel to one another, said molding cheeks further including two side cheeks, and means slidably mounting said side cheeks for movement between said high cheek and said low cheek independently thereof, said means slidably mounting said side cheeks including a rotatably mounted shaft having crank elements, and means coupling said crank elements to an adjacent one of said side cheeks for effecting sliding thereof in response to rotation of said rotatably mounted shaft.

2. A pallet as claimed in claim 1, in which, for at least one of said cheeks belonging to the group formed by said high cheek and said side cheeks, said opening and closure operating means and said locking means are combined in a single device.

3. In an installation for the manufacture of prefabricated elements of plain or reinforced concrete, a mobile pallet comprising: a pouring table, a plurality of molding cheeks continuously coupled to said table and movably mounted individually with respect to said table between a closure position adapted to form with said table a cavity for molding said concrete elements, and an open position permitting de-molding of said elements; and means mounted on said table and associated with each said cheek for actuating the opening and closure of said cheeks and for locking said cheeks in the closed position, said means for locking each of said cheeks in the closed position including an operating lever articulated about a first pivot fixed facing said table, and an elastic coupling lever articulated on said operating lever about a second pivot and on a supporting arm around a third pivot, said levers being adapted to take one of two positions including a locking position and an unlocking position, on each side of an intermediate neutral position for which said pivots are in line and said elastic lever is compressed.

4. A pallet as claimed in claim 3, in which said elastic coupling lever is an accumulator comprising, in a cylinder body, a piston movably mounted and acting against elastic means such as a stack of Belleville washers for example.

5. A pallet as claimed in claim 3, in which said operating lever is provided with a stop, preferably adjustable in length, such as a screw.

6. A pallet as claimed in claim 3, in which the supporting arm of said elastic lever carries a stop, preferably adjustable in length, such as a screw.

7. A pallet as claimed in claim 3, in which said operating lever carries a driving member such as a roller, stud, shaft, rod or the like.

8. A pallet as claimed in claim 3, in which for one of said cheeks the supporting arm of said elastic lever is directly coupled to said one cheek and is articulated on a fixed axis with respect to said table.

9. A pallet as claimed in claim 3 in which said cheeks include at least one side cheek, and for said one side cheek the supporting arm of said elastic lever is keyed on a shaft carried by said table, said shaft having at least one crank to which said one side cheek is connected by a crank-arm.

10. A pallet as claimed in claim 3, in which, for one of said cheeks said operating means for opening and closure are distinct from said locking means, the supporting arm of the elastic lever of said locking means being rigidly fixed on said one cheek, the later also carrying a further arm or side-plate which, articulated on a fixed shaft, carried by said table, is extended beyond said shaft so as to constitute the opening and closure operating means of said one cheek.

* * * * *